United States Patent [19]

Boyesen

[11] 4,388,895

[45] Jun. 21, 1983

[54] FUEL PORTING FOR TWO CYCLE INTERNAL COMBUSTION ENGINE

[75] Inventor: Eyvind Boyesen, Kempton, Pa.

[73] Assignee: Performance Industries, Inc., Kempton, Pa.

[21] Appl. No.: 290,819

[22] Filed: Aug. 7, 1981

Related U.S. Application Data

[63] Continuation of Ser. No. 133,098, Mar. 24, 1980, Pat. No. 4,294,202, which is a continuation-in-part of Ser. No. 941,596, Sep. 12, 1978, Pat. No. 4,202,298, which is a continuation-in-part of Ser. No. 859,476, Dec. 12, 1977, Pat. No. 4,143,626, which is a continuation-in-part of Ser. No. 839,180, Jul. 17, 1979, Pat. No. 4,161,163, which is a continuation-in-part of Ser. No. 674,102, Apr. 6, 1976, Pat. No. 4,062,331, Ser. No. 586,138, Jun. 11, 1975, Pat. No. 4,051,820, which is a continuation-in-part of Ser. No. 375,065, Jun. 29, 1973, Pat. No. 3,905,340, which is a continuation-in-part of Ser. No. 282,734, Aug. 22, 1972, abandoned, and Ser. No. 361,407, May 18, 1973, abandoned.

[51] Int. Cl.[3] ..... F02B 33/04

[52] U.S. Cl. ..... 123/73 PP; 123/73 A

[58] Field of Search ..... 123/73 PP, 73 A, 73 R, 123/73 V, 73 AA, 73 B, 73 E, 74 R, 74 A, 73 CC

[56] References Cited

U.S. PATENT DOCUMENTS

| | | | |
|---|---|---|---|
| 3,687,118 | 8/1972 | Numura | 123/73 PP |
| 3,749,067 | 7/1973 | Kobayashi | 123/73 PP |
| 4,202,298 | 5/1980 | Boyesen | 123/73 A |
| 4,202,299 | 5/1980 | Boyesen | 123/73 A |
| 4,294,202 | 10/1981 | Boyesen | 123/73 PP |

FOREIGN PATENT DOCUMENTS

| | | | |
|---|---|---|---|
| 55-5476 | 1/1980 | Japan | 123/73 PP |

*Primary Examiner*—Wendell E. Burns
*Attorney, Agent, or Firm*—John T. Synnestvedt; Kenneth P. Synnestvedt

[57] ABSTRACT

Two-cycle internal combustion engines are disclosed incorporating intake and transfer ports and passages, and including passages means in the cylinder wall interconnecting the intake tract and a transfer passage in a region above the piston when the piston is in bottom dead center position.

4 Claims, 4 Drawing Figures

FUEL PORTING FOR TWO CYCLE INTERNAL COMBUSTION ENGINE

This application is a continuation of application Ser. No. 133,098, filed Mar. 24, 1980, issued as U.S. Pat. No. 4,294,202 on Oct. 13, 1981, which application is a continuation-in-part of application Ser. No. 941,596, filed Sept. 12, 1978, now U.S. Pat. No. 4,202,298 which is a continuation-in-part of application Ser. No. 859,476, filed Dec. 12, 1977, and issued Mar. 13, 1979 as U.S. Pat. No. 4,143,626, which is a continuation-in-part of application Ser. No. 839,180, and issued July 17, 1979 as U.S. Pat. No. 4,161,163, filed Oct. 4, 1977, which applications are continuations-in-part of certain earlier applications including Ser. No. 674,102, filed Apr. 6, 1976, and issued Dec. 13, 1977, as U.S. Pat. No. 4,062,331, Ser. No. 586,138, filed June 11, 1975, and issued Oct. 4, 1977, as U.S. Pat. No. 4,051,820, which, in its turn, is a continuation-in-part of my application Ser. No. 375,065, filed June 29, 1973, and issued Sept. 16, 1975, as U.S. Pat. No. 3,905,340, which, in its turn, is a continuation-in-part of my prior application Ser. No. 282,734, filed Aug. 22, 1972, now abandoned, and also of my prior application Ser. No. 361,407, filed May 18, 1973, now abandoned.

BACKGROUND OF THE INVENTION

Two cycle internal combustion engines are commonly provided with transfer passages and porting providing for delivery of fuel from the crankcase into the combustion chamber above the piston. Intake porting is provided in order to introduce fuel into the crankcase space for compression therein upon the downward stroke of the piston and for delivery from the crankcase space through the transfer passage means. Intake valves are commonly provided in the intake passageway or intake tract.

The present invention is concerned with improvements in passage and porting arrangements both in the transfer and in the intake systems providing for increase in delivery of fuel into the combustion chamber above the piston. The increase in fuel delivery and the consequent improvement in operation of the engine are accomplished according to the present invention by providing a novel interrelationship between the intake porting and passages and the transfer porting and passages, according to which the intake porting and passages not only deliver the fuel to the crankcase space, but also, deliver fuel by an injector type of action into the transfer fuel flow during the phase of the cycle of operation in which fuel is being transferred from the crankcase to the combustion chamber.

In the arrangements according to the present invention, reed type intake valves are preferably provided in the intake tract, and injector porting or passages are provided in order to deliver fuel from the intake tract substantially directly into the transfer passage means. According to the invention, this may be accomplished in several ways by providing a region of at least one transfer passage intermediate its ends in communication with the intake passage or tract downstream of the valve means. Indeed, in certain arrangements according to the invention, a region of the intake tract downstream of the valve means and a region of at least one transfer passage intermediate its ends are common to each other.

Still further, according to the invention provision is made for increased fuel input by the employment of a novel form of passage means interconnecting the intake tract and the transfer passages and ports close to the point of fuel delivery into the cylinder. Moreover, this is accomplished in accordance with the present invention in a manner which not only increases the intake of fuel but which also enhances the scavenging of the combustion gases from the cylinder under the influence of the incoming fuel.

Several embodiments of engines providing improved operation in various aspects as referred to above are illustrated in the accompanying drawings and described hereinafter.

DETAILED DESCRIPTION

Figure 1:
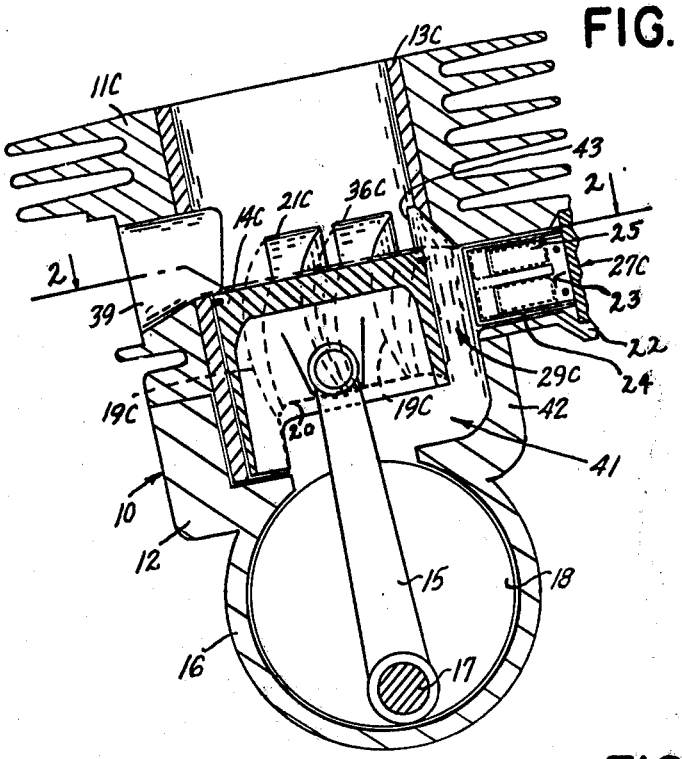
FIG. 1 is a view in section, taken along the line 1—1 of FIG. 2, and illustrating a two cycle reed valve engine having intake and injector porting according to one embodiment also disclosed in companion application Ser. No. 941,596, now U.S. Pat. No. 4,202,298.
Figure 2:
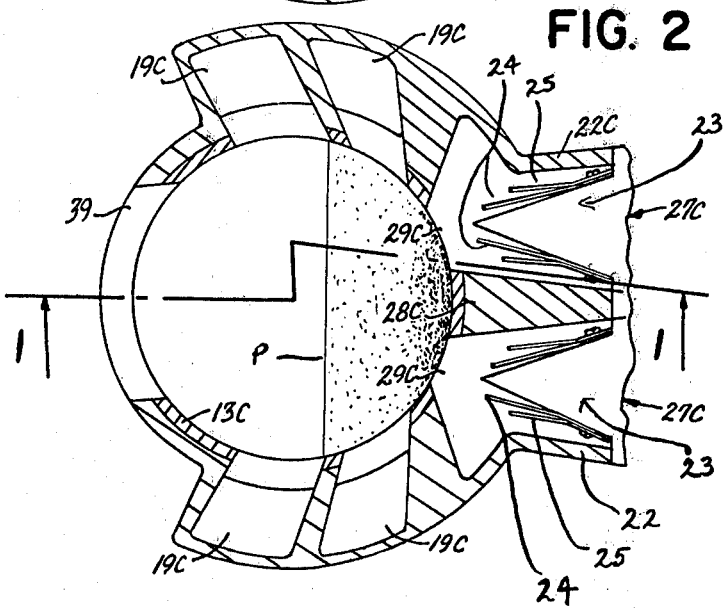
FIG. 2 is a sectional view taken along the line 2—2 of FIG. 1.

FIGS. 1 and 2

Before considering the drawings in detail, it is first pointed out that FIGS. 1 and 2 are respectively the same as FIGS. 5 and 6 of my prior application Ser. No. 941,596, now U.S. Pat. No. 4,202,298, identified above. Since the structure of these figures is shown and described in the companion application referred to, reference may be had to said companion application for various details. Significant parts of the apparatus shown in these figures are also described herebelow, and certain portions of this description correspond to portions appearing in the companion application where the structural features are the same. It is to be noted, however, that in FIG. 2 there is included a diagrammatic illustration of certain operating conditions which (while they would occur in the engine as shown in the companion application) are not illustrated in the companion application.

In FIGS. 1 and 2, there is shown a somewhat diagrammatic representation of a two-cycle engine comprised of a housing 10 the upper portion of which defines a cylinder 11C and the lower portion of which defines a crankcase 12. The upper, annular portion of the crankcase interfits with cylinder liner structure 13C, which extends throughout the height of the cylinder 11C, except where omitted or removed to provide certain porting (including the usual exhaust port 39), and projects beneath it in the manner plain from FIG. 1. While the use of a liner is preferred, it is not essential, and for most purposes of the present invention, the liner can be considered as a part of the cylinder 11C, which, in turn, forms the upper portion of housing 10. A piston 14C is mounted for reciprocation within the cylinder and its connecting rod 15 is eccentrically mounted upon the crankshaft within the lower portion 16 of the crankcase, as indicated at 17. As is conventional, a circular counterweight is preferably employed, as shown at 18.

The cylinder 11C includes transfer passages 19C, two being provided at each side of the cylinder in this embodiment, the lower end of each of which is in open communication with the crankcase and the upper end of each of which terminates in a transfer port, one of which is indicated at 21C and another of which is indicated at 36C. A similar pair is provided at the opposite side of the cylinder. The transfer ports are exposed in the cylinder above the piston when the piston is in bottom dead center position. Conveniently, and as shown, the passages 19C are provided in the wall of cylinder 11C, lying behind the liner 13C, which is apertured to provide the lower communication at 20 as well as the upper ports 21C and 36C. As is conventional, combustible gases inletted during the upward stroke are pressurized beneath the piston and in the crankcase by the piston throughout its downward stroke toward the bottom dead center position illustrated, and the gases flow from the crankcase through openings 20, passages 19C and ports 21C and 36C, from whence the gases enter the cylinder above the piston 14C.

The cylinder 11C also includes an intake chamber 22 which leads to a source of fuel (not illustrated) and which chamber contains the reed valve means 23, which is adapted to open and provide for intake of fuel throughout the entire upward stroke of the piston, and to close, during the downward stroke of the piston, when the fuel inletted into the space below the piston is being compressed. While, for certain purposes of the present invention, the reed valve means 23 may take a variety of forms known in the art, it is preferred that said reed valve means be of the so-called "vented" type described and claimed in my earlier disclosures and particularly in U.S. Pat. No. 3,905,340, to which reference may be had for a more detailed description. It is also preferred that the valve means includes a plurality of valve assemblies as described hereinafter.

In the embodiment illustrated in FIGS. 1 and 2, the reed valve means 23 includes a reed valve body or cage of wedge shape, with the base end of the wedge interiorly open to the fuel supply passage, each inwardly inclined surface of the wedge-shaped cage having a pair of valve ports and each such port provided with primary and secondary reeds 24 and 25, the primary reeds being vented. This valving arrangement is more fully illustrated and described in my U.S. Pat. No. 3,905,340 above identified. The opposite sides or ends (top and bottom) of the reed valve cage are provided with parallel triangular walls.

From FIG. 2, it will be seen that the embodiment of FIGS. 1 and 2 includes two valve assemblies 23 arranged in side-by-side relation and positioned respectively in separate intake passages 27C,27C lying at opposite sides of the dividing wall 28C. The fuel entering through the valves 24, 25 flows directly into the cylinder intake passages 29C and also laterally and downwardly into additional intake passages to be described.

It is desirable, as shown in FIGS. 1 and 2, that each reed cage be positioned with its apex extended in a vertical direction, i.e., in a direction parallelling the axis of the cylinder. When positioned in the manner just referred to, it will be clear from inspection of FIG. 2 that the flow of fuel through the valve ports controlled by the reed valves or petals 24 and 25, substantially directly enters the passages downstream of the valves, without the necessity for any extensive or sharp angular deflection. These and other factors are of importance in maximizing the input of fuel into the engine.

The above mentioned directness of flow is enhanced by virtue of the arrangement as shown in which a pair of reed valve assemblies are mounted in separate generally parallel intake passages 27C,27C, as established by intervening wall structure including partition 28C.

It will be seen from inspection of FIGS. 1 and 2 that the arrangement here shown not only includes two transfer passages 19C at each side of the cylinder, but also includes a combined intake and transfer passage at each side. The combined intake and transfer passages are described below but it is first pointed out that the transfer passages are provided with appropriate ports into the combustion space and also have their lower ends communicating with a chamber 41 formed within the upper portion 12 of the engine housing 10, this chamber also communicating with the lower portion of the crankcase but being located above the crank and counterweight space immediately adjacent to the lower ends of the transfer passages.

As seen in FIGS. 1 and 2, the intake passages or tracts 29C downstream of the reed valves 23 have communication with the chamber 41 and the crankcase space; and this communication is arranged within the wall structure 42 in such manner as to remain open throughout the entire cycle of operation of the engine, including bottom dead center position of the piston. The intake passages or tracts 29C also extend upwardly for communication with the cylinder ports 43, one such port being provided for each of the passages 29C. These ports 43 are preferably positioned at substantially the same level in the cylinder as the ports 21C and 36C of the transfer passages 19C, and the ports 43 serve a similar function, but also directly communicate with the intake system just downstream of the valves. It will be observed that the intake passages 29C receive fuel from the valves *27c* in a region above the chamber 41 and intermediate the ports 43 and the zone in which the passages 29C communicate with chamber 41 and the crankcase. Therefore, during the lower portion of the downward or compression stroke of the piston, the intake passages 29C serve to deliver compressed fuel from the chamber 41 and thus from the crankcase upwardly into the combustion chamber, in the general manner of a transfer passage, but since these passages 29C have communication with the fuel supply, at least at higher speeds of operation, additional fuel is supplied to the flow by virtue of the action referred to in various of the companion applications as the injector action.

It is also to be noted that since the chamber 41 in the immediate vicinity of the lower ends of the transfer passage 19C directly communicates with the intake passages or tracts 29C, under certain conditions of operation, the delivery of fuel into the combustion space through the transfer passages 19C is also augmented.

It will be noted that in effect at least a region of each passage 29C serves in part as an intake tract and in part as a transfer passage.

FIGS. 3 AND 4

Figure 3:
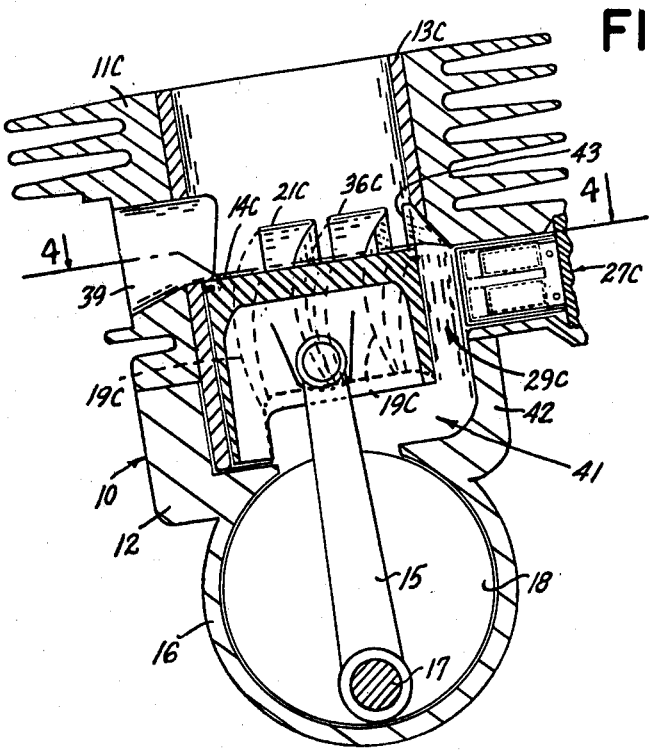
FIGS. 3 and 4 are views similar to FIGS. 1 and 2, and illustrating an embodiment of one engine similar to that of FIGS. 1 and 2, but incorporating a novel arrangement of porting and passages hereinafter fully described.
Figure 4:
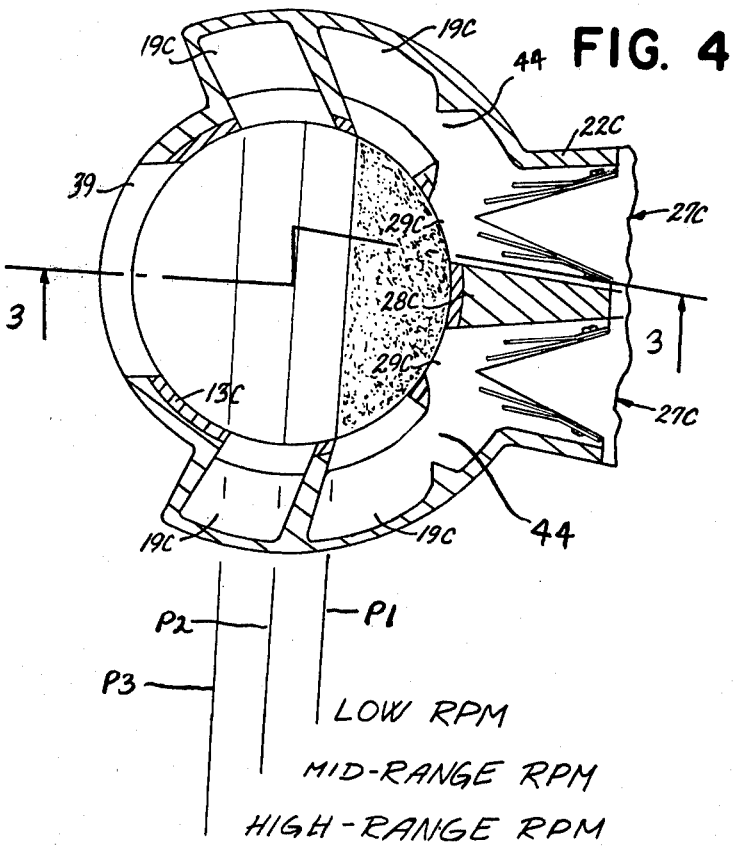

The embodiment shown in FIGS. 3 and 4 incorporates most of the structure described above in connection with FIGS. 1 and 2, but in addition the embodiment of FIGS. 3 and 4 includes some additional passage means providing intercommunication between the intake tract and one of the transfer passages at each side of the cylinder. Thus, comparison of FIG. 4 with FIG. 2 will show that a passage 44 is provided in FIG. 4 at each side of the cylinder between the intake/transfer passage 29C and the adjacent transfer passage 19C; whereas in FIG. 2, these two passages are shown separated by an intervening wall.

Attention is also called to the fact that FIG. 4 is taken on a section line 4—4 applied to FIG. 3 which section line is somewhat higher than the top of the piston in bottom dead center position. It will thus be seen that the passage means 44 interconnects the fuel supply and the adjacent transfer passage in a region above the piston when the piston is in bottom dead center position; i.e., in the region immediately adjacent to the pair of cylinder ports 36C–43 at each side.

In the embodiment of FIGS. 3 and 4, therefore, the intercommunication between the fuel supply and a transfer passage at each side of the cylinder is not only provided in a region near the lower ends of the transfer passages, but also near the upper ends thereof; and as will be explained hereinafter, this latter zone of intercommunication between the intake and the transfer system is of benefit not only in increasing the fuel intake capability, but also in improving the scavenging action by which the exhaust gases are discharged through the exhaust port 39 under the influence of the incoming fuel.

The structural embodiment shown in FIGS. 1 and 2 is identical to that shown in FIGS. 5 and 6 of companion application Ser. No. 941,596, now U.S. Pat. No. 4,202,298; and the structural embodiment of FIGS. 3 and 4 is the same except for the additional passage means described above.

CONCLUSION

Both of the embodiments shown in the drawings and described above include intake tracts or passages from the fuel supply and valve cages in constant communication with the crankcase space or chamber in a region below the piston throughout the entire cycle of operation of the engine including the bottom dead center position. This communication is maintained at normal operating speeds without requiring reversal of flow through the transfer passages; and as brought out in certain of my cross referenced applications and patents above identified, this is of importance in augmenting fuel input to the combustion chamber. It will further be seen that in both embodiments, a chamber 41 is provided below the piston and above the crank and counterweight space in the crankcase, with which chamber not only the intake tract communicates but with which the inlet end of the transfer passages also communicate. This chamber is partially separated from the crank and counterweight space in the crankcase by the configuration of the wall structure of the engine housing. The intercommunicating opening between the chamber and the crank and counterweight space in the crankcase is, of course, adequate to accommodate the connecting rod 15 and its motions, but, particularly at high engine speeds, the crank and counterweight space is in effect a "dead" space and the chamber 41 is a "live" and very active space, through which fuel passes at high rate from the intake side of the system to the transfer side of the system, and thus to the combustion chamber. This fuel flow occurs at high engine speeds in a manner which is not substantially influenced by the fact that the chamber 41 is in communication with the crank and counterweight space. One of the reasons why this flow is not substantially influenced by the communication between the chamber and the crank and counterweight space is the fact that the chamber is immediately adjacent to the piston whereas the crank and counterweight space is remote from the piston and it is the piston motion which acts to reduce and increase the pressure in the chamber, as occurs on the suction and compression strokes of the piston. This action of the piston originates immediately under the piston and is, therefore, highly effective in providing the desired pressure fluctuations in the chamber; and at high speeds, such fluctuations are not communicated to any substantial extent downwardly to the more remote space where the crank and counterweight are enclosed in the engine housing, provided that the intake porting is located at least as high as this chamber 41.

As to most of the fuel flow passages, it is also of importance that complete reversal of the direction of flow is not required, as such reversal, particularly at high engine speeds, has a tendency to diminish delivery of fuel, because of the inertia of the fuel itself. Even in the case of the intake passages 29C, at normal operating speeds, the fuel flow through the passages 29C is in the upward direction throughout the cycle of operation and this is of importance in maintaining high velocity of flow and thereby provide the fuel injector effect contemplated according to the invention.

In both of the embodiments illustrated and described, the supply of fuel to the combustion space by virtue of transfer flow of the fuel from the compression side of the piston to the combustion side of the piston is augmented by an injector or induction type of action resulting in flow of some fuel from the intake or supply passages substantially directly into the transfer flow without previous compression in the space below the piston. This action is of appreciable effect over a substantial range of engine speeds and is particularly significant at high engine speeds, and this is particularly true of the intake/transfer passages 29C.

In further explanation of the significant differences in the functions of the arrangement of FIGS. 3 and 4 as compared with the arrangement of FIGS. 1 and 2, attention is now directed to the diagrammatic representation in FIG. 2 of the pressure condition in the cylinder above the piston during the inletting of fuel and the scavenging of exhaust gases. The line marked P in FIG. 2 which is extended across the cylinder, schematically represents the zero pressure line in the cylinder above the piston during the inletting of fuel through the ports 21C, 36C and 43. By zero pressure condition is here meant a pressure equal to the ambient or atmospheric pressure, and the fluctuations above and below that value as referred to hereinafter are of course values above and below atmospheric pressure. Similarly, the line P and the fluctuations described with relation to that line may also be understood as velocity fluctuations, i.e., fluctuations in the velocity of the fuel entering the cylinder at the right side and proceeding to the left. Actually the flow is upwardly directed from the ports 21C, 36C and 43 and thence laterally and downwardly, but the line P represents the zero condition in a plane intermediate the piston and the top of the cylinder. The line P not only represents zero velocity, but also zero pressure, as explained above.

It will be noted that to the right of the line P stippling has been applied within the area of the cylinder, with an increase in the density of the stippling as the cylinder wall is approached at the intake side of the of the engine. This variation in the density of the stippling indicates that in consequence of the input of fuel when the piston is near the bottom dead center position, the velocity and pressure is greater adjacent the intake side and diminishes as the line P is approached. To the left of the line P the pressure and velocity would normally be somewhat lower than the zero value referred to.

From the above, it will be seen that in the embodiment as illustrated in FIGS. 1 and 2 the fuel intake in consequence of the porting and passage arrangements is increased and in addition this increase favorably influences the scavenging action. However, as explained herebelow, the modification incorporated in the embodiment shown in FIGS. 3 and 4 still further enhances not only the fuel intake but also the scavenging action of the incoming fuel. It will be observed from FIG. 4 that the pressure or velocity line P is indicated in three different positions at P1, P2 and P3, representing typical "Low", "Mid-range", and "High-range" RPM rates. It will be understood that the stippled area to the right of the pressure line P1 in FIG. 4 would be of progressively greater area with increase in speed, as is indicated by the positions of the lines P2 and P3. This is a point of significant difference between the embodiment of FIGS. 3 and 4 on the one hand and the embodiment of FIGS. 1 and 2 on the other hand. With the porting and passage arrangement of FIGS. 1 and 2, the location of the zero velocity or pressure line P remains relatively constant throughout the speed of the engine; and in addition the stippled area to the right of the pressure line P in FIG. 2, as already mentioned, increases substantially in density (i.e. the pressure and velocity increases) as the cylinder wall adjacent the intake side is approached.

The arrangement of FIGS. 3 and 4 has two differences as compared with the arrangement of FIGS. 1 and 2. In the first place, there is a much greater variation in the location of the zero line depending upon the speed of operation of the engine, the pressure line progressively approaching the exhaust side of the cylinder as the engine speed is increased. Moreover, while there is more variation in the density of the stippling to the right of the line P1 in FIG. 4, the variation is not as great as it is with the embodiment of FIGS. 1 and 2.

The foregoing differences between the embodiment of FIGS. 3 and 4 as compared with the embodiment of FIGS. 1 and 2 result from the fact that with the additional passage means 44 interconnecting the intake/-transfer passages 29C with the adjacent transfer passages 19C occurs principally above the level of the piston in bottom dead center position, with consequent increase in direct fuel flow from the intake system into the space immediately above the piston.

The arrangement of FIGS. 3 and 4 therefore, not only increases the overall fuel intake but also enhances the scavenging action especially at high engine speeds, which occurs when the piston descends and uncovers the ports 21C, 36C and 43, there being a set of these three ports at each side of the cylinder, as will be apparent from examination of FIGS. 3 and 4.

In connection with the references herein to the crankcase and the cylinder, and to the location of various ports and passages, it should be kept in mind that a portion of what is functionally the wall of the cylinder is often (for instance as shown in the drawings) actually located within the confines of the metal of the crankcase casting.

Moreover, various of the ports and passages provided in two-cycle engines, including intake porting and passages and transfer porting and passages, are quite often extended from a region lying within the metal of the cylinder casting into a region lying within the metal of the crankcase casting, or vice versa. From the standpoint of the operation and functioning of the various ports and passages, and the operation and functioning of the engines as a whole, it is not significant just where the parting line occurs separating the metal of the "cylinder" from the metal of the "crankcase", nor is it of any significance just which part of the metal of which part of the engine is traversed by some particular passage.

I claim:

1. A two-cycle, crankcase compression internal combustion engine having a cylinder with a piston movable in the cylinder between top and bottom dead center positions, fuel intake porting in the cylinder positioned to be controlled by the piston, reed valve controlled intake passage means communicating with the intake porting, the intake porting and passage means being positioned toward one side of the cylinder, exhaust porting at the side of the cylinder opposite to the intake porting, transfer ports in the cylinder wall, a first one of said transfer ports being positioned at a first side of the cylinder between the intake porting and the exhaust porting and the second one of said transfer ports being positioned at a second side of the cylinder opposite to said first side between the intake porting and the exhaust porting, auxiliary transfer porting in the cylinder wall at a level above the intake porting and communicating with the intake passage means, and two auxiliary passages in communication with the intake passage means independently and offset from each other, one toward said first side wall of the cylinder and the other toward said second side wall of the cylinder, said two auxiliary passages being in communication with the crankcase throughout the piston stroke and even in bottom dead center position of the piston.

2. An engine as defined in claim 1 in which said intake porting comprises two intake ports, in which said intake passage means comprises two passages, and in which said auxiliary passages are respectively connected with the two intake passages.

3. A two-cycle, crankcase compression internal combustion engine having a cylinder with a piston movable in the cylinder between top and bottom dead center positions, fuel intake porting in the cylinder positioned to be controlled by the piston, intake passage means communicating with the intake porting, the intake porting and passage means being positioned toward one side of the cylinder, exhaust porting at the side of the cylinder opposite to the intake porting, transfer porting in the cylinder wall and including port means having communication with the intake passage means throughout the piston stroke, the transfer porting including a first transfer port positioned at a first side of the cylinder between the intake porting and the exhaust porting and a second transfer port positioned at a second side of the cylinder opposite to said first side between the intake porting and the exhaust porting, two auxiliary passages in communication with the intake passage means independently and offset from each other, one toward said first side wall of the cylinder and the other toward said second side wall of the cylinder, said two auxiliary passages being in communication with the crankcase independently and offset from each other, one toward said first side wall of the cylinder and the other toward said second side wall of the cylinder, and said two auxiliary passages being in communication with the crankcase throughout the piston stroke and even in bottom dead center position of the piston, and reed valve means controlling the fuel flow through the intake passage means and said auxiliary passages.

4. A two-cycle, crankcase compression internal combustion engine having a cylinder with a piston movable in the cylinder between top and bottom dead center positions, fuel intake porting in the cylinder positioned to be controlled by the piston, reed valve controlled intake passage means communicating with the intake porting, the intake porting and passage means being positioned toward one side of the cylinder, exhaust porting at the side of the cylinder opposite to the intake porting, transfer ducts in the cylinder wall, a first one of said transfer ducts being positioned at a first side of the cylinder between the intake porting and the exhaust porting and the second one of said transfer ducts being positioned at a second side of the cylinder opposite to said first side between the intake porting and the exhaust porting, each transfer duct having a transfer port through the cylinder wall above the piston in bottom dead center position and each transfer duct having a duct entrance in communication with the crankcase even in bottom dead center position, auxiliary transfer porting in the cylinder wall at a level above the intake porting and communicating with the intake passage means, and two auxiliary passages in communication with the intake passage means independently and offset from each other, one toward said first side wall of the cylinder and the other toward said second side wall of the cylinder, the auxiliary passage at one side having communication with the transfer duct and the crankcase at that side of the cylinder throughout the piston stroke and even in bottom dead center position of the piston, and the auxiliary passage at the other side having communication with the transfer duct and the crankcase at said other side of the cylinder throughout the piston stroke and even in bottom dead center position of the piston.

* * * * *